US008050611B2

(12) United States Patent
Kinouchi et al.

(10) Patent No.: US 8,050,611 B2
(45) Date of Patent: Nov. 1, 2011

(54) FIXING DEVICE AND IMAGE FORMING APPARATUS

(75) Inventors: Satoshi Kinouchi, Tokyo (JP); Kazuhiko Kikuchi, Kanagawa (JP); Hiroshi Nakayama, Shizuoka (JP); Hiroaki Yamauchi, Shizuoka (JP); Shuji Yokoyama, Shizuoka (JP)

(73) Assignees: Kabushiki Kaisha Toshiba, Tokyo (JP); Toshiba TEC Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/754,327

(22) Filed: Apr. 5, 2010

(65) Prior Publication Data

US 2010/0260525 A1 Oct. 14, 2010

Related U.S. Application Data

(60) Provisional application No. 61/183,648, filed on Jun. 3, 2009, provisional application No. 61/183,645, filed on Jun. 3, 2009, provisional application No. 61/168,167, filed on Apr. 9, 2009.

(51) Int. Cl.
*G03G 15/20* (2006.01)

(52) U.S. Cl. ..... 399/330; 219/216; 219/619; 399/334

(58) Field of Classification Search ..... 399/334, 399/333, 330, 329, 328; 219/216, 619; 347/156
See application file for complete search history.

(56) References Cited

U.S. PATENT DOCUMENTS

| | | | | |
|---|---|---|---|---|
| 6,078,781 | A * | 6/2000 | Takagi et al. | 399/330 |
| 6,625,417 | B1 | 9/2003 | Terada et al. | |
| 7,129,448 | B2 * | 10/2006 | Matsunaga et al. | 219/619 |
| 7,386,243 | B2 | 6/2008 | Kinouchi et al. | |
| 2003/0152406 | A1 | 8/2003 | Terada et al. | |
| 2003/0170055 | A1 | 9/2003 | Terada et al. | |
| 2004/0081490 | A1 | 4/2004 | Terada et al. | |
| 2004/0265021 | A1 * | 12/2004 | Kinouchi et al. | 399/334 |
| 2005/0067408 | A1 | 3/2005 | Fujii et al. | |
| 2008/0019742 | A1 * | 1/2008 | Ohno | 399/333 |
| 2008/0124151 | A1 | 5/2008 | Kagawa | |
| 2008/0285996 | A1 | 11/2008 | Kinouchi et al. | |
| 2009/0142114 | A1 * | 6/2009 | Yasuda et al. | 399/333 |
| 2009/0226202 | A1 * | 9/2009 | Kinouchi et al. | 399/334 X |
| 2009/0297237 | A1 * | 12/2009 | Shimatani et al. | 399/329 |

FOREIGN PATENT DOCUMENTS

| | | | |
|---|---|---|---|
| JP | 2000-206813 | A | 7/2000 |
| JP | 2001-318545 | A | 11/2001 |
| JP | 2007-132993 | A | 5/2007 |
| JP | 2007-264021 | A * | 10/2007 |
| JP | 2009-128551 | A | 6/2009 |

* cited by examiner

*Primary Examiner* — Sophia S Chen
(74) *Attorney, Agent, or Firm* — Patterson & Sheridan, LLP

(57) ABSTRACT

Plural main cores and plural sub-cores are arranged spaced apart from each other along a direction orthogonal to a rotating direction of a heat belt. The plural main cores are opposed to a first area where a sheet having first width in the heat belt passes. The plural sub-cores are opposed to second areas that are areas excluding the first area in an area where the sheet having second width larger than the first width in the heat belt passes. The plural sub-cores have thickness in the direction orthogonal to the rotating direction of the heat belt smaller than the thickness of the plural main cores.

20 Claims, 18 Drawing Sheets

FIXING DEVICE AND IMAGE FORMING APPARATUS

CROSS-REFERENCE TO RELATED APPLICATION

This application is based upon and claims the benefit of priority from U.S. Provisional Applications 61/168,167 filed Apr. 9, 2009, 61/183,645, filed Jun. 3, 2009 and 61/183,648, filed Jun. 3, 2009, the entire contents of which are incorporated herein by reference.

TECHNICAL FIELD

Exemplary embodiments described herein relates to a fixing device of an induction heating system and an image apparatus provided with a fixing device of an induction heating system.

BACKGROUND

An image forming apparatus reads an image from an original document, forms a toner image corresponding to the read image on a sheet, and fixes the toner image on the sheet using a fixing device.

The fixing device holds the sheet between a rotating member, for example, a fixing roller or a heat belt and a pressing member, for example, a press roller and applies heat and pressure to the sheet to thereby fix the toner image on the sheet.

An excitation coil for induction heating is provided near the rotating member. High-frequency current flows to the excitation coil, whereby a high-frequency magnetic field is generated from the excitation coil. Eddy-current is generated in the rotating member by the high-frequency magnetic field. The rotating member generates heat with Joule heat based on the eddy-current.

When a small-size sheet passes between the rotating member and the pressing member, the temperature on both the sides of the rotating member not in contact with the sheet is higher than the temperature in the center of the rotating member in contact with the sheet. When the temperature on both the sides of the rotating member rises to be higher than the temperature in the center thereof, the hardness of an elastic member such as rubber forming both the sides of the rotating member falls earlier than the hardness of an elastic member such as rubber forming the center. Therefore, the life of the rotating member is reduced.

Immediately after the small-size sheet passes between the rotating member and the pressing member, when a full-size sheet passes between the rotating member and the pressing member, a toner on the full-size sheet offsets to both the sides of the rotating member in a high-temperature state and causes a fixing failure.

Therefore, in JP-A-2001-318545, first cores are arranged in a position corresponding to an area where sheets of all usable sizes pass and second cores having a Curie point lower than that of the first cores are arranged in positions corresponding to areas excluding the passing area. When temperature rises to exceed the Curie point, the magnetic permeability of the second cores falls and the second cores prevent magnetic fluxes from passing. Consequently, a temperature rise of the rotating member in the sheet non-passing area is suppressed.

However, in this case, since two kinds of cores having different Curie points have to be prepared, cost increases.

SUMMARY

A fixing device disclosed herein includes:

a rotating member configured to rotate;

a pressing member configured to rotate together with the rotating member while being set in contact with the rotating member, hold a fixing object between the pressing member and the rotating member, and apply pressure to the fixing object;

plural cores arranged spaced apart from each other along a direction orthogonal to a rotating direction of the rotating member, the plural cores having different shapes in a position opposed to a first area in the rotating member where a fixing object having first width passes and in positions opposed to second areas that are areas excluding the first area in an area where a fixing object having second width larger than the first width passes; and an excitation coil mounted on the plural cores and configured to generate a high-frequency magnetic field for induction-heating the rotating member.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

DESCRIPTION OF THE DRAWINGS

The accompanying drawings, which are incorporated in and constitute a part of the specification, illustrate presently embodiments, and together with the general description given above and the detailed description of the preferred embodiments given below, serve to explain the principles of the invention.

DETAILED DESCRIPTION

[1] First Embodiment

Figure 1:
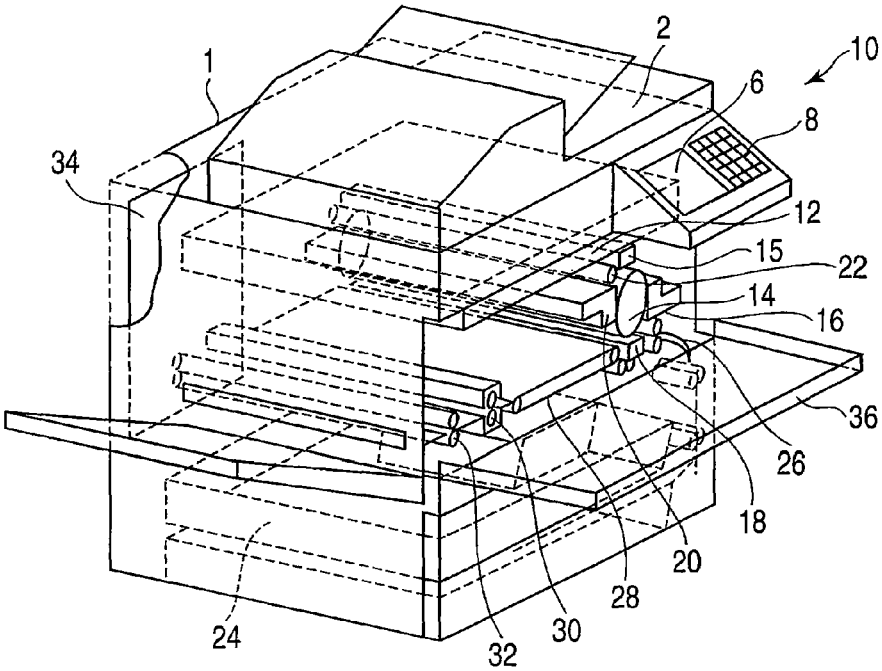
FIG. 1 is a perspective view of an image forming apparatus according to a first embodiment.

Hereinafter, a first embodiment will be described with reference to the drawings. FIG. 1 is a perspective view of an image forming apparatus. An image forming apparatus 1 is provided with an image reader 2 to read in an image which is an object to be read in and an image forming portion to form an image. In addition, at the upper portion of the image forming apparatus 1, an operation panel 10 having a display 6 of a touch panel type and various type operation keys 8 is provided. The operation panel 10 is located at the side face of the image forming apparatus 1, namely at a front side that is a near side in the plane of paper. The back side of the image forming apparatus 1 in the plane of paper is a rear side. The right side of the image forming apparatus 1 in the plane of paper is a right side. The left side of the image forming apparatus 1 in the plane of paper is a left side.

The operation key 8 of the operation panel 10 has a numeric keypad, a reset key, a stop key, a start key and so on, for example. In the display 6, various handlings are inputted such as the sheet size, the number of copies, printing density setting and pullout handling and so on.

The image forming portion is provided with a laser unit 12, a photoconductor 14, a charger 15, a developing device 16, a transfer device 18, a cleaner 20, and a neutralization device 22. The image forming apparatus 1 is further provided with a sheet supply device 24, a sheet conveying path 26, a sheet conveying belt 28, a fixing device 30, an ejection roller 32, a circuit board 34, and a maintenance door 36.

The charger 15 charges the outer circumference surface of the rotating photo conductor 14. The laser unit 12 forms an electrostatic latent image on the charged outer circumference surface of the photoconductor 14. The developing device 16 develops the electrostatic latent image into a toner image with the toner. The transfer device 18 transfers the toner image on the sheet conveyed from the sheet supply device 24 through the sheet conveying path 26. The cleaner 20 cleans away the toner which remains at the photoconductor 14 without being transferred. The neutralization device 22 neutralizes the outer circumference surface of the photoconductor 14.

The sheet conveying belt 28 conveys the sheet on which the toner image was transferred to the fixing device 30. The fixing device 30 fixes the toner image on the sheet. The ejection roller 32 ejects the sheet on which the toner image was fixed from the image forming apparatus 1.

The image forming apparatus 1 is provided with the maintenance door 36 at the front side so as to open up the circuit board 34 which electrically controls the image forming portion including the electric supply to the fixing device 30 toward the rear side and open up the fixing device 30 toward the front side. The circuit board 34 faces the rear side end surface of the fixing device 30 in the length direction. The circuit board 34 generates heat and makes the rear side of the image forming apparatus 1 at a high temperature by blocking the air flow. The space inside the maintenance door 36 is made at a low temperature by ventilating the front side of the image forming apparatus 1. The rear side of the image forming apparatus 1 is made at a higher temperature than the front side.

Figure 2:
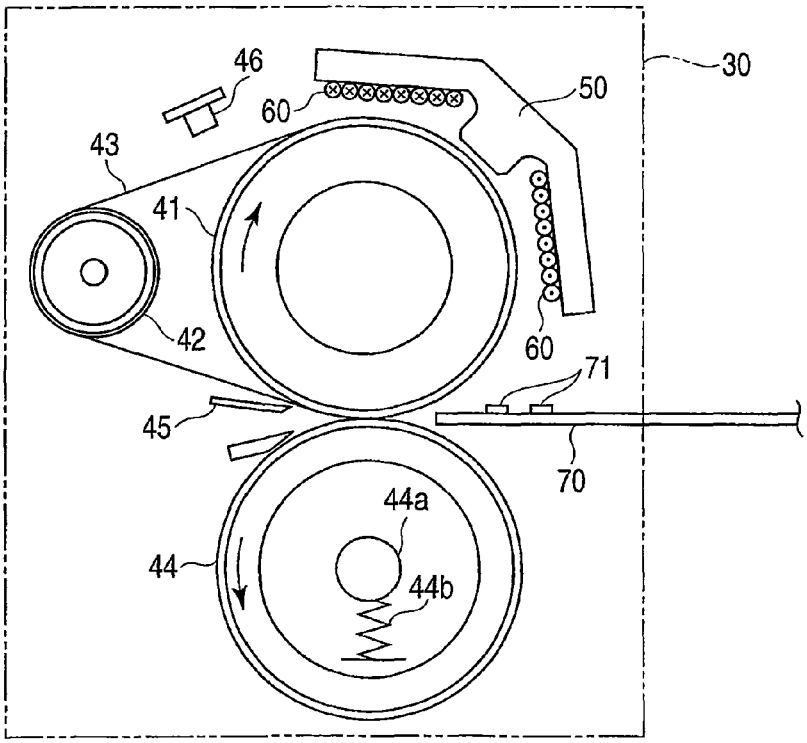
FIG. 2 is a sectional view of a fixing device in the first embodiment.

FIG. 2 is a sectional view of the fixing device 30. The fixing device 30 includes a fixing roller 41, a tension roller 42, and a heat belt 43 as a rotating member laid over between the fixing roller 41 and the tension roller 42. The heat belt 43 and a press roller 44 as a pressing member hold a conveying path for a sheet 70, which is a fixing object, from above and below. The press roller 44 is set in contact with the surface of the heat belt 43 in a pressing state. The press roller 44 rotates together with the heat belt 43, holds the sheet 70 between the press roller 44 and the heat belt 43, and applies pressure to the sheet 70. At this point, heat of the heat belt 43 is transmitted to the sheet 70, whereby a toner 71 on the sheet 70 melts and the melted toner 71 is fixed on the sheet 70.

The fixing roller 41 includes a cored bar having a diameter of 50 mm and thickness of 2 mm and foamed rubber having thickness of 5 mm and rotates in an arrow direction with the power of a motor. In the heat belt 43, a solid rubber layer having thickness of 200 μm and a peeling layer having thickness of 30 μm are formed in order on a metal conductive layer having thickness of 40 μm. The lateral width of the heat belt 43 is larger than the lateral width of a largest size of the sheet 70. The heat belt 43 rotates in an arrow direction according to the rotation of the fixing roller 41. As the metal conductive layer, nickel, stainless steel, aluminum, a composite material of stainless steel and aluminum, or the like is used. As the solid rubber layer, silicon rubber is used. As the peeling layer, a PFA tube is used. The press roller 44 includes a rotating shaft 44*a* and two springs 44*b* for applying upward deflecting force to the rotating shaft 44*a*.

Figure 3:
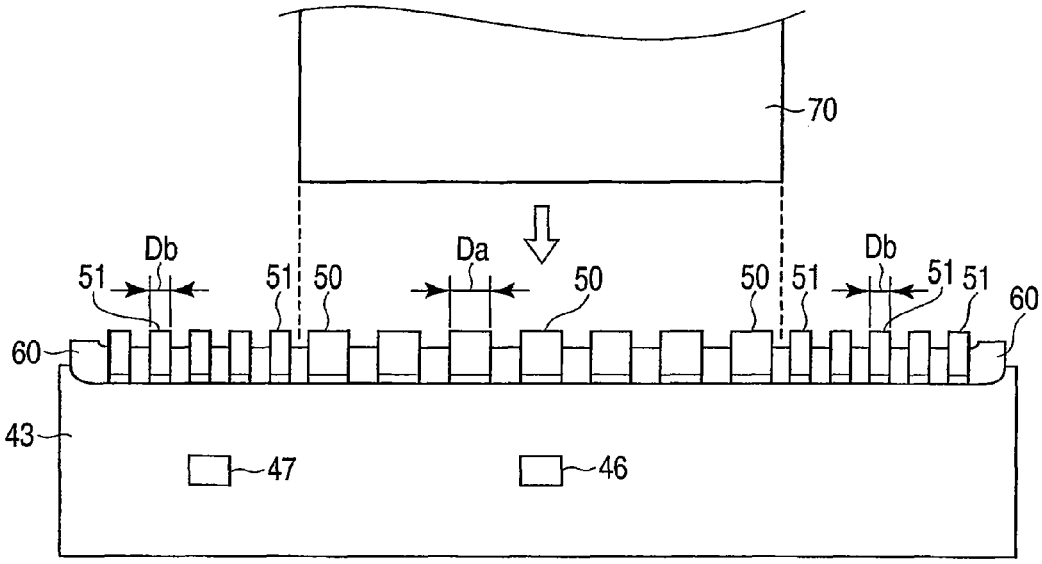
FIG. 3 is a top view of the fixing device shown in FIG. 2 viewed from above.

The fixing device 30 shown in FIG. 2 viewed from above is shown in FIG. 3. As shown in FIG. 3, plural main cores 50 as first cores and plural sub-cores 51 as second cores are arranged spaced apart from each other in a position on the fixing roller 41 opposed to the heat belt 43 along a direction orthogonal to the rotating direction of the heat belt 43. An excitation coil 60 that generates a high-frequency magnetic field for induction heating for the heat belt 43 is mounted on the main cores 50 and the sub-cores 51. The plural main cores 50 and the plural sub-cores 51 apply magnetic fluxes of the high-frequency magnetic field generated by the excitation coil 60 to the heat belt 43. A direction orthogonal to the rotating direction of the heat belt 43 is hereinafter referred to as lateral width direction of the heat belt 43.

The excitation coil 60 is formed by winding a Litz wire obtained by binding, for example, sixteen insulation-coated copper wire materials having a wire diameter of 0.5 mm. The Litz wire can be compressed in the radial direction to reduce the wire diameter.

Figure 4:
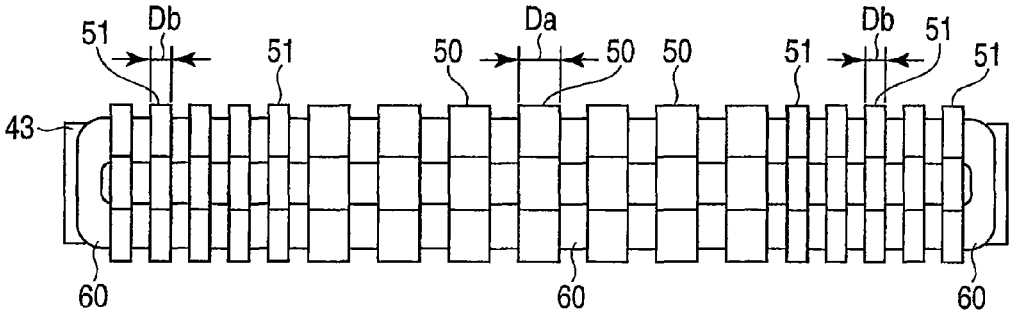
FIG. 4 is a side view of the fixing device shown in FIG. 3 viewed from a cores side.

The fixing device 30 shown in FIG. 3 viewed from the coils side is shown in FIG. 4. The plural main cores 50 are arranged at fixed intervals in the center of the heat belt 43, i.e., a position corresponding to a first area where the sheet 70 having first width passes. The plural sub-cores 51 are arranged at fixed intervals at one end and the other end of the heat belt 43, i.e., in positions opposed to second areas that are areas excluding the first area in an area where a fixing object having second width larger than the first width passes. The plural main cores 50 and the plural sub-cores 51 are magnetic bodies such as ferrite that are only different in shapes but are made of the same material.

In particular, the plural main cores 50 have thickness Da in the lateral width direction of the heat belt 43. The plural sub-cores 51 have thickness Db in the lateral width direction of the heat belt 43. The thickness Db of the plural sub-cores 51 is smaller than the thickness Da of the plural main cores 50. For example, the thickness Db is a half of the thickness Da. When the thickness Da is set to 10 mm, the thickness Db is set to 5 mm. A mutual interval of the plural sub-cores 51 is smaller than a mutual interval of the plural main cores 50.

A blade 45 for peeling the sheet 70 from the heat belt 43 and a first temperature sensor 46 and a second temperature sensor 47 of a thermopile type configured to detect the temperature of the surface of the heat belt 43 in a non-contact state are arranged around the heat belt 43. The first temperature sensor 46 captures an infrared ray emitted by the heat belt 43 to thereby detect temperature T1 of the first area in the heat belt 43. The second temperature sensor 47 captures an infrared ray emitted by the heat belt 43 to thereby detect temperature T2 of the second areas in the heat belt 43. The temperature sensors 46 and 47 are not limited to the non-contact type separated from the heat belt 43 and may be a contact type that is set in contact with the surface of the heat belt 43.

Figure 5:
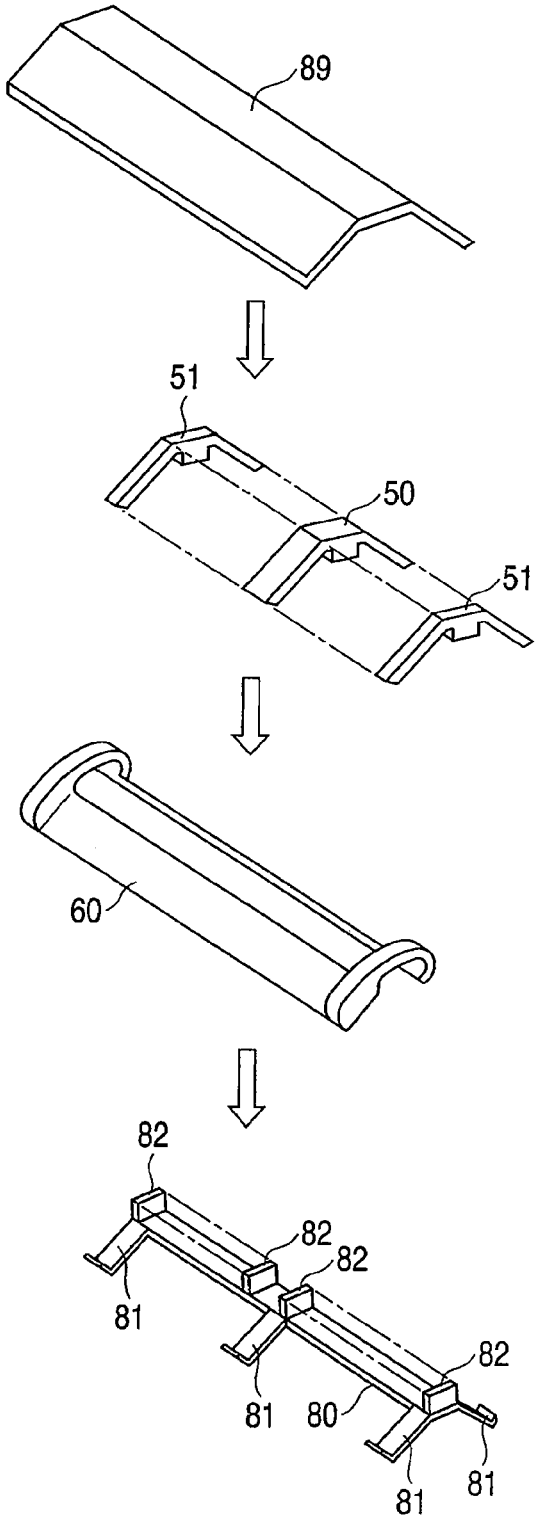
FIG. 5 is a disassembled perspective view of an excitation coil, cores, and a configuration for holding the cores in the first embodiment.

A configuration for holding the excitation coil 60, the plural main cores 50, and the plural sub-cores 51 is shown in FIG. 5. Arms 81 in plural places in an insulative holder 80 spread along the circumferential direction of the heat belt 43. The excitation coil 60 is mounted on the arms 81. Plural ribs 82 in an upper part of the holder 80 pass through an inner space of the excitation coil 60. The plural main cores 50 and the plural sub-cores 51 are fit and fixed among the ribs 82. A fixing cover 89 is put on the plural main cores 50 and the plural sub-cores 51.

Figure 6:
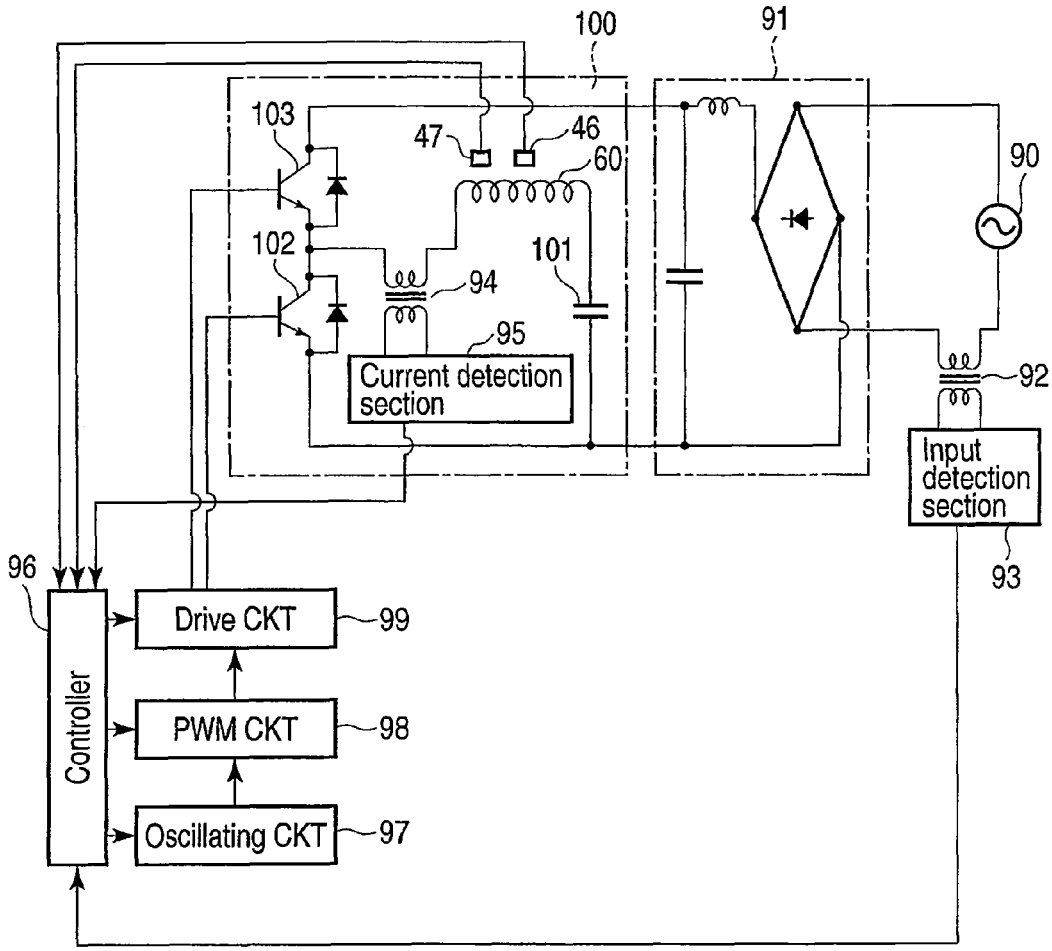
FIG. 6 is a block diagram of an electric circuit of the fixing device in the first embodiment.

An electric circuit of the fixing device 30 is shown in FIG. 6. A rectifying circuit 91 is connected to a commercial AC power supply 90. An inverter circuit (also called switching circuit) 100 of a half-bridge type for high-frequency current generation is connected to an output end of the rectifying circuit 91. The inverter circuit 100 includes a resonant capacitor 101 forming a resonant circuit together with the excitation coil 60 and switching elements, for example, transistors 102 and 103 for exciting the resonant circuit. The inverter circuit 100 feeds high-frequency current to the excitation coil 60 by alternately turning on and off the transistors 102 and 103. A high-frequency magnetic field is generated from the excitation coil 60 by the high-frequency current. The plural main cores 50 and the plural sub-cores 51 apply magnetic fluxes of the high-frequency magnetic field, which is generated from the excitation coil 60, to the heat belt 43. Eddy-current is generated in the heat belt 43 by the magnetic fluxes. The heat belt 43 generates heat with Joule heat based on the eddy-current.

As the transistors 102 and 103, IGBTs or MOS-FETs that can withstand high voltage and large current are used. An ON period of the transistor 102 is always fixed. An ON period of the transistor 103 changes, whereby a level of high-frequency current flowing to the excitation coil 60 changes. According to the change in the level, an output of the excitation coil 60 changes.

A current transformer 92 is connected to an energizing path between the commercial AC power supply 90 and the rectifying circuit 91. An input detection section 93 is connected to an output end of the current transformer 92. The input detection section 93 detects input power to the fixing device 30.

A current transformer 94 is connected to an energizing path of the excitation coil 60 in the inverter circuit 100. A current detection section 95 is connected to an output end of the current transformer 94. The current detection section 95 detects high-frequency current flowing to the excitation coil 60.

The temperature sensors 46 and 47, the input detection section 93, the current detection section 95, an oscillating circuit 97, a PWM circuit 98, and a drive circuit 99 are connected to a controller 96. The oscillating circuit 97 outputs an AC voltage signal having a frequency corresponding to a command from the controller 96 among frequencies from 20 to 70 kHz. The PWM circuit 98 subjects an output of the oscillating circuit 97 to pulse-width modulation to thereby generate a driving signal of on or off duty corresponding to a command from the controller 96. The drive circuit 99 drives to turn on and off the transistors 102 and 103 according to the driving signal generated by the PWM circuit 98.

The controller 96 includes, as main functions, control sections (1) and (2) explained below.

(1) A first control section configured to control an output of the excitation coil 60 via the PWM circuit 98 and the drive circuit 99 in order to maintain detected temperature T1 of the first temperature sensor 46 at a set value decided in advance, for example, 170° C. and configured to reduce the output of the excitation coil 60 via the PWM circuit 98 and the drive circuit 99 when detected temperature T2 of the second temperature sensor 47 abnormally rises.

(2) A second section configured to detect a heating load from high-frequency current detected by the current detection section 95 and control an oscillation frequency of the oscillating circuit 97 according to the detected heating load.

Actions are explained below.

The controller 96 drives the excitation coil 60 at, for example, maximum power of 1100 W. According to the driving, high-frequency current flows to the excitation coil 60 and a high-frequency magnetic field is generated from the excitation coil 60. The plural main cores 50 and the plural sub-cores 51 apply magnetic fluxes of the high-frequency magnetic field, which is generated from the excitation coil 60, to the heat belt 43. Consequently, the heat belt 43 generates heat.

The first temperature sensor 46 detects the temperature T1 of the heat belt 43. The controller 96 controls an output of the excitation coil 60 in order to maintain the detected temperature T1 of the first temperature sensor 46 at the set value 170° C. At this point, the temperature of the plural main cores 50 and the plural sub-cores 51 rises with radiation heat from the heat belt 43. The temperature of the plural main cores 50 and the plural sub-cores 51 changes to about 150° C. when the sheet 70 of a full size such as the A3 size or the A4 landscape size continuously passes between the heat belt 43 and the press roller 44.

Figure 7:
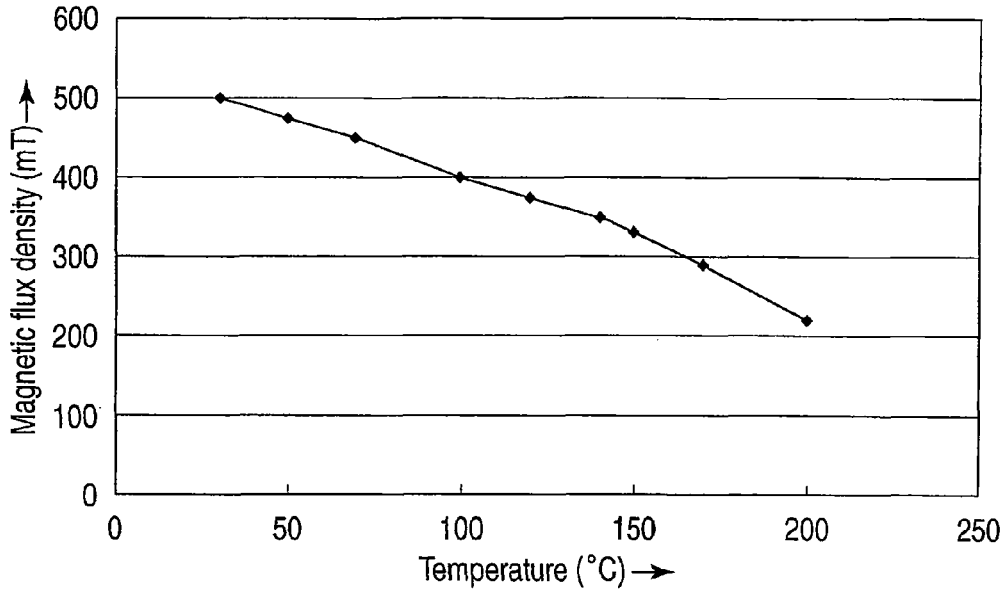
FIG. 7 is a graph of a relation between the temperature and the magnetic flux density of the cores in the first embodiment.

A relation between the temperature and the magnetic flux density of the plural main cores 50 and the plural sub-cores 51 is shown in FIG. 7. The magnetic flux density of the plural main cores 50 and the plural sub-cores 51 decreases as the temperature rises.

The number of magnetic fluxes passing through the plural main cores 50 and the plural sub-cores 51 depends on high-frequency current flowing to the excitation coil 60. When the temperature of the plural main cores 50 and the plural sub-cores 51 is equal to or lower than about 150° C., even when the excitation coil 60 is driven at the maximum power 1100 W, the number of magnetic fluxes passing through the plural main cores 50 and the plural sub-cores 51 does not exceed saturated magnetic flux density of the plural main cores 50 and the plural sub-cores 51. However, when the temperature of the plural sub-cores 51 is about 150° C., the number of magnetic fluxes passing through the plural sub-cores 51 is close to the saturated magnetic flux density.

When the sheet 70 having a small size such as the A4 portrait size or the B5 size continuously passes between the heat belt 43 and the press roller 44, the sheet 70 deprives heat of the center as the first area of the heat belt 43. On both the sides of the heat belt 43 as the second areas, since the sheet 70 does not deprive heat, temperature rises higher than temperature in the center. At this point, the temperature of the plural sub-cores 51 rises exceeding 150° C. with radiation heat from both the sides of the heat belt 43. When the temperature of the plural sub-cores 51 exceeds 150° C., the number of magnetic fluxes passing through the plural sub-cores 51 exceeds the saturated magnetic flux density of the sub-cores 51 and the magnetic fluxes leak to the outside. In other words, the plural sub-cores 51 change to a magnetic saturation state.

When the plural sub-cores 51 change to the magnetic saturation state, the number of magnetic fluxes applied to both the sides of the heat belt 43 by the plural sub-cores 51 decreases and eddy-current generated on both the sides of the heat belt 43 decreases. This makes it possible to suppress a temperature rise on both the sides of the heat belt 43.

Figure 8:
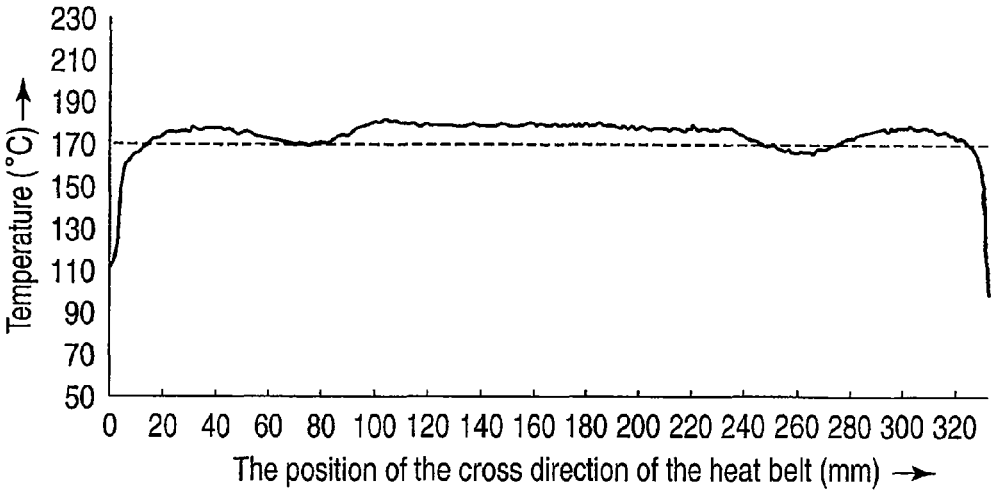
FIG. 8 is a graph of temperature distribution in a width direction of a heat belt in the first embodiment.

At this point, since a heating load decreases, the impedance of the excitation coil 60 decreases and the high-frequency current increases. When high-frequency current detected by the current detection section 95 exceeds a set value, the controller 96 raises an oscillation frequency of the oscillating circuit 97. Since the oscillation frequency rises, apparent impedance of the excitation coil 60 increases. This makes it possible to suppress an increase in high-frequency current. Therefore, the temperatures in the center and on both the sides of the heat belt 43 are uniformalized at the control temperature 170° C. as shown in FIG. 8.

As explained above, the plural main cores 50 are arranged in the position opposed to the center of the heat belt 43 and the plural sub-cores 51 having thickness smaller than that of the plural main cores 50 are arranged in positions opposed to both the ends of the heat belt 43. This makes it possible to maintain the temperatures uniform in the center and on both the sides of the heat belt 43.

Therefore, the hardness of an elastic member on both the sides in the axis direction of the fixing roller 41 set in contact with the heat belt 43 does not fall earlier than the hardness of an elastic member in the center in the axis direction of the fixing roller 41. Consequently, the life of the fixing roller 41 and the peripheral components of the fixing roller 41 is improved.

Immediately after the sheet 70 having the small size passes between the heat belt 43 and the press roller 44, even when the sheet 70 having the full size passes between the heat belt 43 and the press roller 44, the toner 71 on the sheet 70 does not offset to both the sides of the heat belt 43. This enables more satisfactory fixing.

In particular, the plural main cores 50 and the plural sub-cores 51 are magnetic bodies such as ferrite that are only different in shapes but are made of the same material. Therefore, it is unnecessary to prepare two kinds of cores made of different materials and it is possible to prevent an increase in cost.

[2] Second Embodiment

Figure 9:
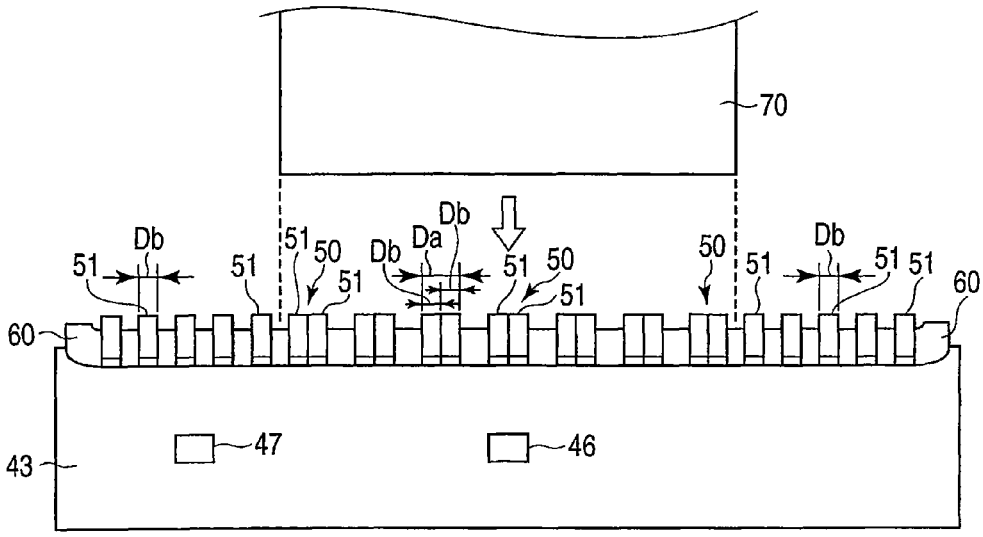
FIG. 9 is a top view of the configuration of cores and a peripheral section of the cores in a second embodiment.
Figure 10:
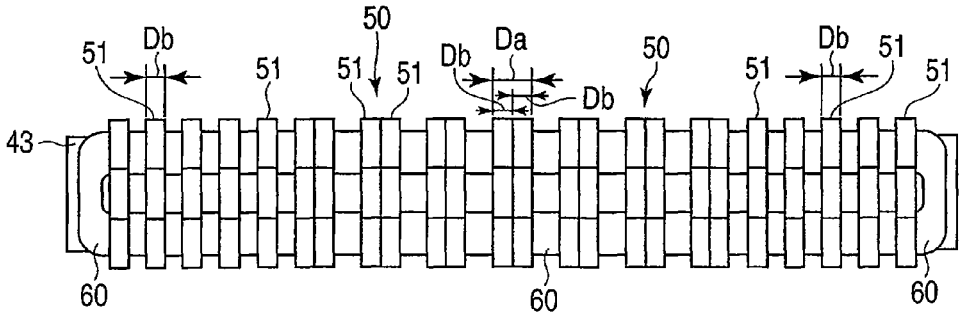
FIG. 10 is a side view of the configuration shown in FIG. 9 viewed from the core sides.

With attention paid to the fact that the thickness Db of the plural sub-cores 51 is a half of the thickness Da of the plural main cores 50, the plural main cores 50 having a configuration shown in FIGS. 9 and 10 are adopted. Each of the plural main cores 50 is obtained by joining two cores having width same as that of the plural sub-cores 51.

Since only the cores having a shape same as that of the plural sub-cores 51 have to be prepared, only one kind of a mold for forming cores is necessary. Cost also decreases in this regard.

Other components and actions are the same as those in the first embodiment. Therefore, explanation of the components and actions is omitted.

[3] Third Embodiment

Figure 11:
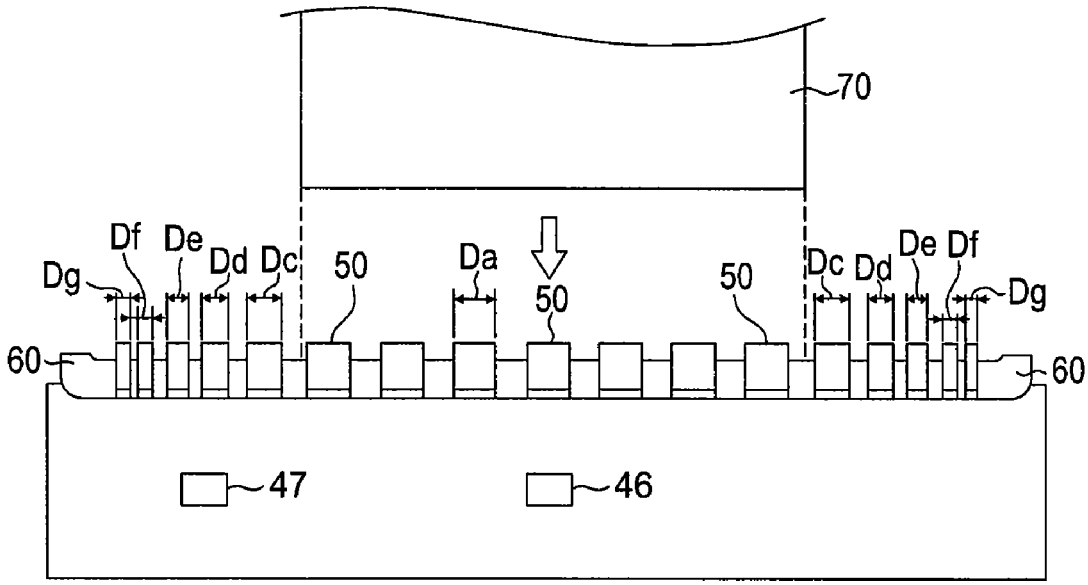
FIG. 11 is a top view of the configuration of cores and a peripheral section of the cores in a third embodiment.

As shown in FIG. 11, the plural sub-cores 51 gradually have smaller thicknesses Dc, Dd, De, Df, and Dg farther away from the center of the heat belt 43. The plural sub-cores 51 having the thickness Dg present in the endmost positions change to the magnetic saturation state earlier than the other sub-cores 51 according to a temperature rise.

Other components and actions are the same as those in the first embodiment. Therefore, explanation of the components and actions is omitted.

[4] Fourth Embodiment

Figure 12:
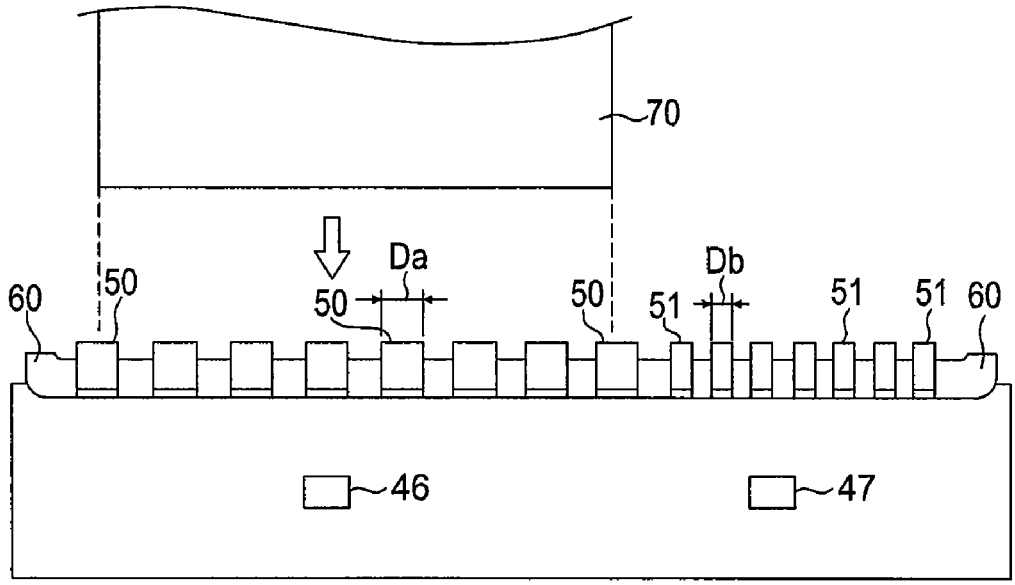
FIG. 12 is a top view of the configuration of cores and a peripheral section of the cores in a fourth embodiment.

As shown in FIG. 12, the first area where the sheet 70 having the first width in the heat belt 43 passes is near one end of the heat belt 43. Therefore, the arrangement of the plural main cores 50 and the plural sub-cores 51 is changed.

Other components and actions are the same as those in the first embodiment. Therefore, explanation of the components and actions is omitted.

[5] Fifth Embodiment

Figure 13:
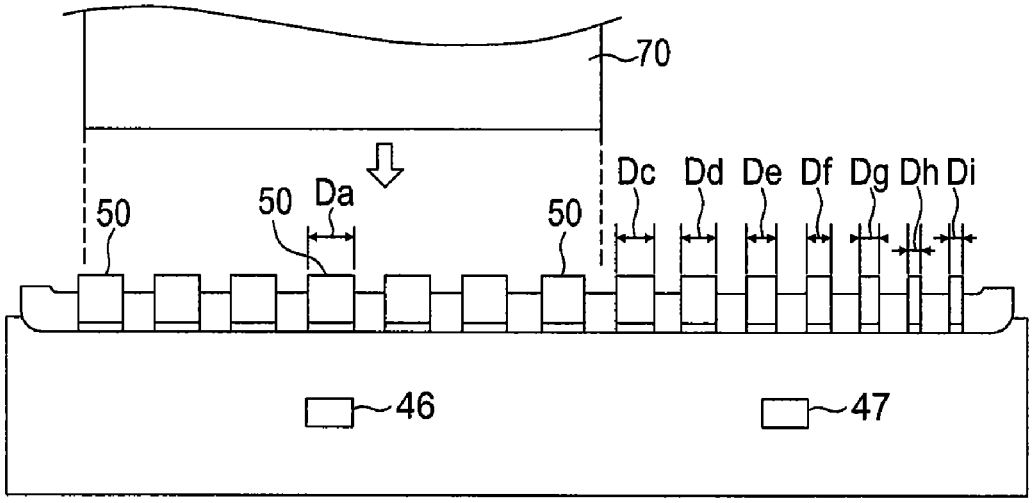
FIG. 13 is a top view of the configuration of cores and a peripheral section of the cores in a fifth embodiment.

As shown in FIG. 13, the first area where the sheet 70 having the first width in the heat belt 43 passes is near one end of the heat belt 43. Therefore, the arrangement of the plural main cores 50 and the plural sub-cores 51 is changed. The plural sub-cores 51 gradually have smaller thicknesses Dc, Dd, De, Df, Dg, Dh, and Di farther away from the first area in the heat belt 43. The sub-cores 51 having the thickness Di present in the endmost positions change to the magnetic saturation state earlier than the other sub-cores 51 according to a temperature rise.

Other components and actions are the same as those in the first embodiment. Therefore, explanation of the components and actions is omitted.

[6] Sixth Embodiment

Figure 14:
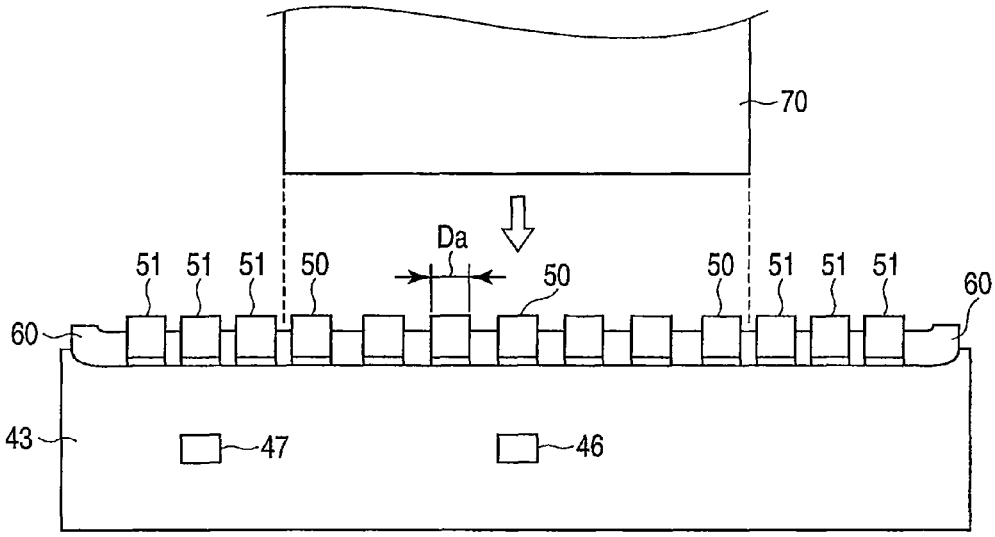
FIG. 14 is a top view of the configuration of cores and a peripheral section of the cores in a sixth embodiment.
Figure 15:
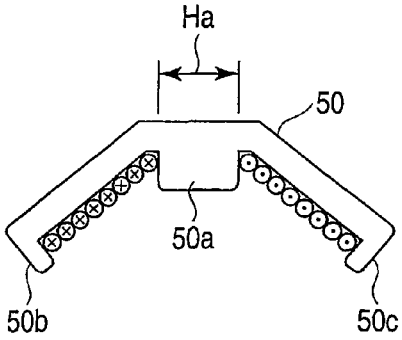
FIG. 15 is a sectional view of the configuration of main cores in the sixth embodiment.

As shown in FIG. 14, the plural sub-cores 51 have thickness Da same as that of the plural main cores 50. As shown in FIG. 15, the plural main cores 50 have an E shape and include three sections 50*a*, 50*b*, and 50*c* having a projected shape. The sections 50*a*, 50*b*, and 50*c* having the projected shape are closer to the heat belt 43 than the other sections. The width of the section 50*a* having the projected shape in the center along the rotating direction of the heat belt 43 is Ha.

Figure 16:
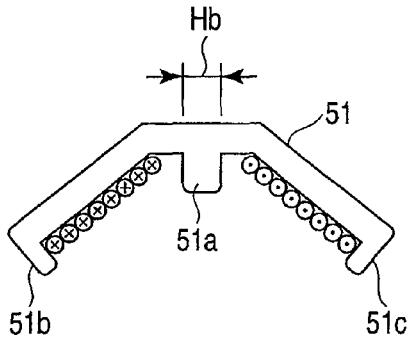
FIG. 16 is a sectional view of the configuration of sub-cores in the sixth embodiment.

As shown in FIG. 16, the plural sub-cores 51 have an E shape and include three sections 51*a*, 51*b*, and 51*c* having a projected shape. The sections 51*a*, 51*b*, and 51*c* having the projected shape are closer to the heat belt 43 than the other sections. The width of the section 51*a* having the projected shape in the center along the rotating direction of the heat belt 43 is Hb. The width Hb is smaller than the width Ha of the section 50*a* having the projected shape of the plural main cores 50. For example, Ha is 12 mm and Hb is 7 mm.

The plural sub-cores 51 change to the magnetic saturation state when temperature exceeds 150° C.

Other components and actions are the same as those in the first embodiment. Therefore, explanation of the components and actions is omitted.

[7] Seventh Embodiment

Figure 17:
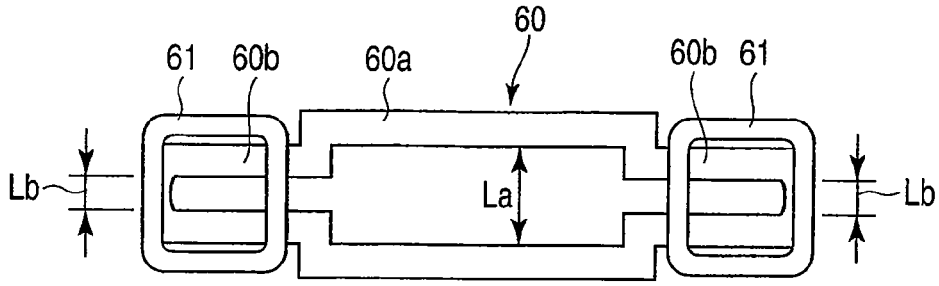
FIG. 17 is a top view of the configuration of an excitation coil and demagnetizing coils in a seventh embodiment.

As shown in FIG. 17, a first section 60*a* in the center of the excitation coil 60 is opposed to the first area of the heat belt 43. Second sections 60*b* at both the ends of the excitation coil 60 are opposed to the second areas of the heat belt 43. The width in an inner opening of the first section 60*a* along the rotating direction of the heat belt 43 is La. The second sections 60*b* have a shape narrowed to the inner side along the rotating direction of the heat belt 43. The width in inner openings of the second sections 60*b* along the rotating direction of the heat belt 43 is Lb. The width Lb is smaller than the width La of the first section 60*a*.

Demagnetizing coils 61 are respectively superimposed on the second sections 60*b* of the excitation coil 60. Each of the demagnetizing coils 61 is formed by winding a Litz wire obtained by binding, for example, sixteen insulation-coated copper wire materials having a wire diameter of 0.5 mm. The demagnetizing coils 61 generate high-frequency magnetic fields for canceling magnetic fluxes of high-frequency magnetic fields generated by the second sections 60*b* of the excitation coil 60.

Figure 18:
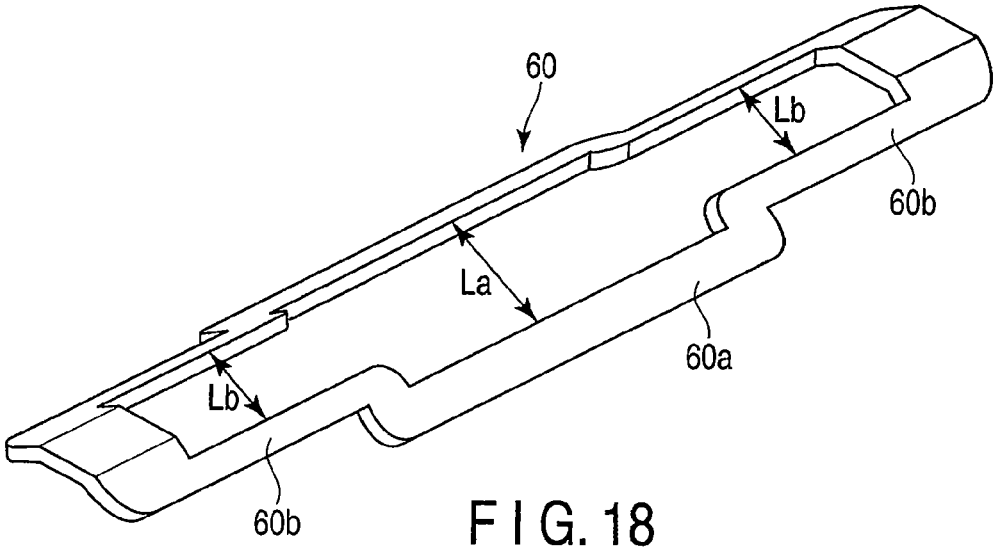
FIG. 18 is a perspective view of a shape of the excitation coil in the seventh embodiment.
Figure 19:
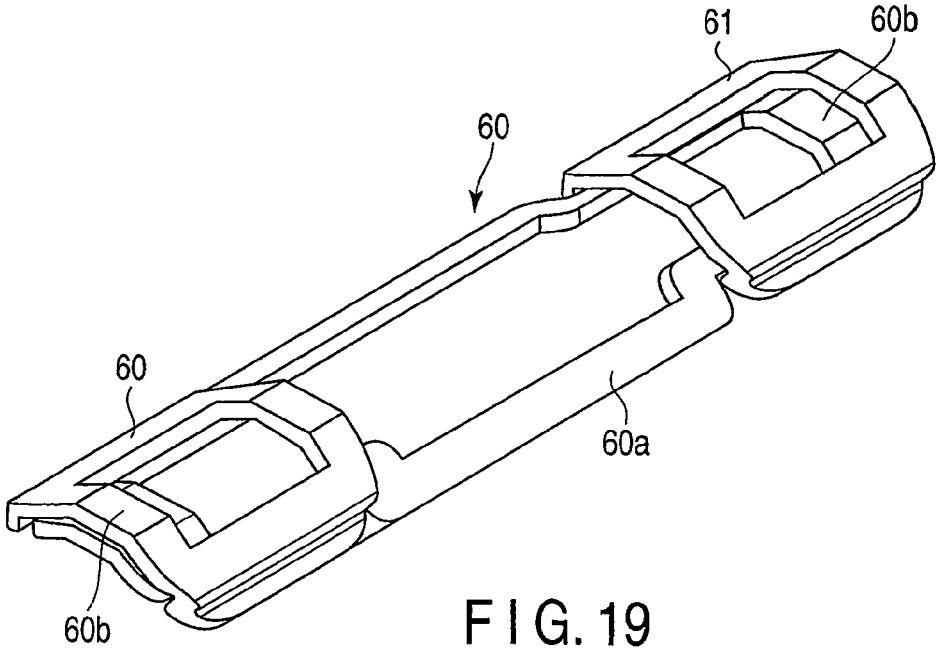
FIG. 19 is a perspective view of a state of mounting of the demagnetizing coils on the excitation coil in the seventh embodiment.
Figure 20:
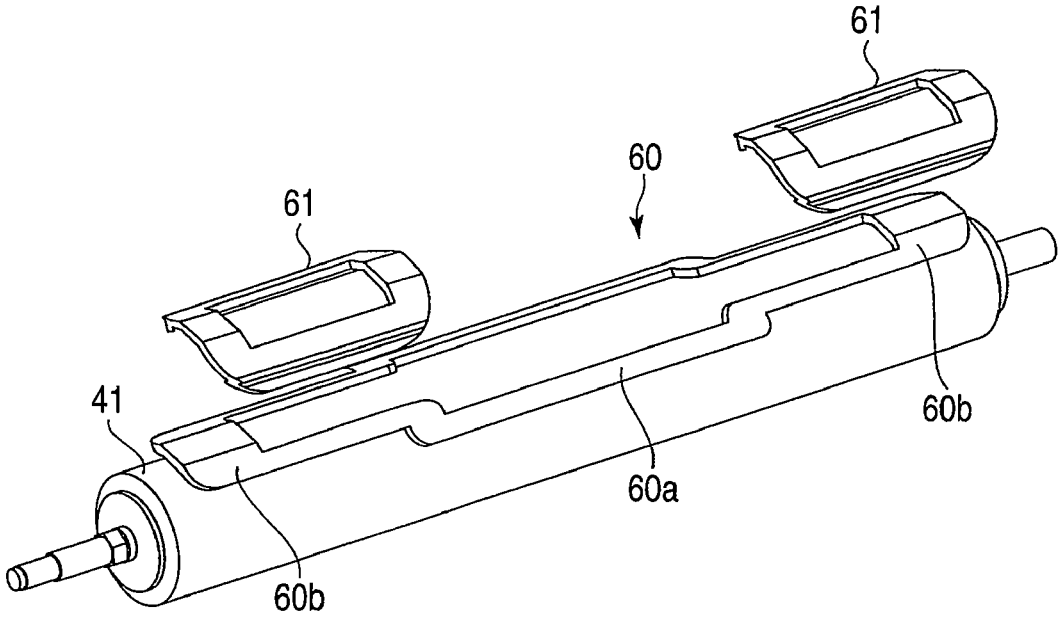
FIG. 20 is a disassembled perspective view for explaining a mutual relation between the excitation coil and the demagnetizing coils in the seventh embodiment.
Figure 21:
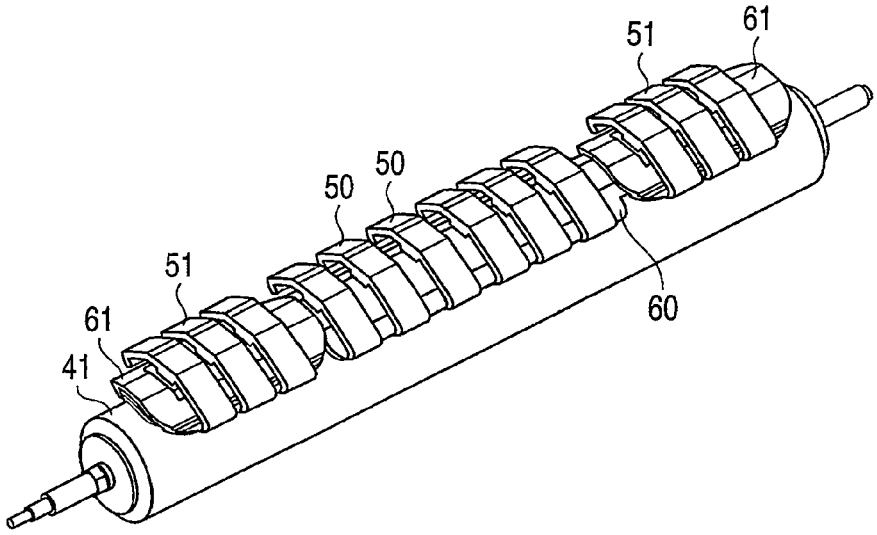
FIG. 21 is a perspective view of the configuration of the excitation coil, the demagnetizing coils, main cores, and sub-cores in the seventh embodiment.
Figure 22:
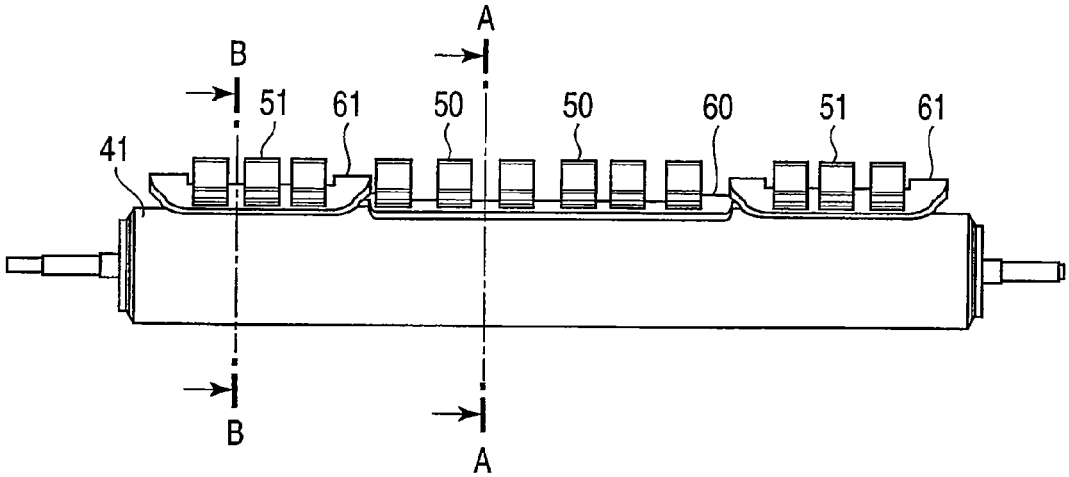
FIG. 22 is a side view of the configuration shown in FIG. 21 viewed from a side.

The shape of the excitation coil 60 is shown in FIG. 18. A state of mounting of the demagnetizing coils 61 on the excitation coil 60 is shown in FIG. 19. A mutual relation between the excitation coil 60 and the demagnetizing coils 61 is shown in FIG. 20 in a disassembled form. The configuration of the excitation coil 60, the demagnetizing coils 61, the plural main cores 50, and the plural sub-cores 51 is shown in FIG. 21. The configuration shown in FIG. 21 viewed from a side is shown in FIG. 22. The plural main cores 50 and the plural sub-cores 51 have the same thickness each other.

Figure 23:
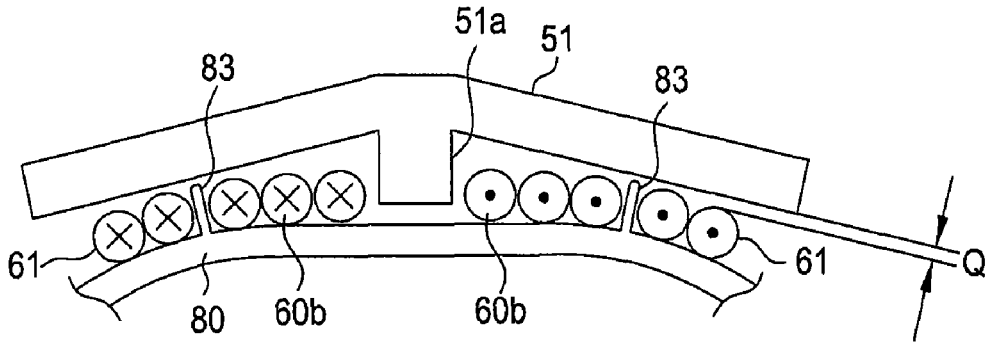
FIG. 23 is a sectional view of a section along line B-B in FIG. 22 viewed in an arrow direction.

A section along line B-B in FIG. 22 is shown in FIG. 23. Since both sides opposed to each other of the second sections 60*b* of the excitation coil 60 are narrowed to the inner side, sides opposed to each other of the demagnetizing coils 61 can be directly placed on the upper surface of the holder 80 together with the excitation coil 60. Consequently, the demagnetizing coils 61 can be set as close as possible to the heat belt 43. Moreover, a placing space for the demagnetizing coils 61 can be reduced as much as possible. Further, a space dimension Q between the excitation coil 60 and demagnetizing coils 61 and the plural sub-cores 51 can be freely selected. For example, if the space dimension Q is set small, magnetic coupling between the excitation coil 60 and demagnetizing coils 61 and the heat belt 43 is intensified. Conversely if the space dimension Q is set large, the magnetic coupling between the excitation coil 60 and demagnetizing coils 61 and the heat belt 43 is weakened.

Plural insulating ribs 83 in an upper part of the holder 80 enter between the second sections 60*b* of the excitation coil 60 and the demagnetizing coils 61 and insulate the second sections 60*b* and the demagnetizing coils 61.

Figure 24:
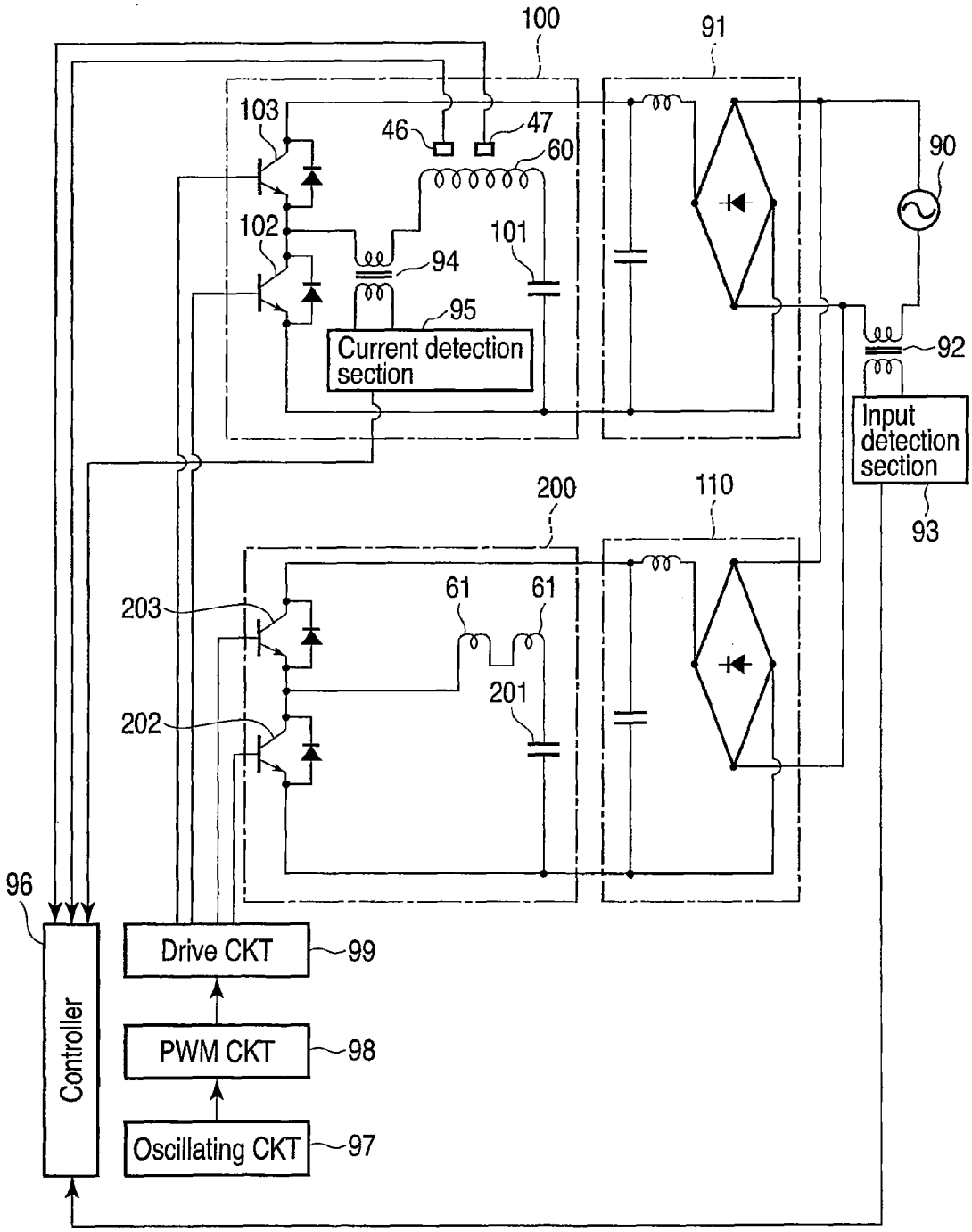
FIG. 24 is a block diagram of an electric circuit of the fixing device in the seventh embodiment.

An electric circuit of the fixing device 30 is shown in FIG. 24. Rectifying circuits 91 and 110 are connected to the commercial AC power supply 90. The inverter circuit 100 of the half-bridge type for high-frequency current generation is connected to the output end of the rectifying circuit 91. An inverter circuit 200 of the half-bridge type for high-frequency current generation is connected to an output end of the rectifying circuit 110. The inverter circuit 200 includes a resonant capacitor 201 configured to form a resonant circuit together with the demagnetizing coils 61 and switching elements, for example, transistors 202 and 203 for exciting the resonant circuit. The inverter circuit 200 feeds high-frequency current to the demagnetizing coils 61 by alternately turning on and off the transistors 202 and 203. The transistors 202 and 203 are connected to the controller 96.

The controller 96 drives the inverter circuit 200 such that a phase of high-frequency current flowing to the demagnetizing coils 61 is different from a phase of high-frequency current flowing to the excitation coil 60 by 180 degrees. Consequently, the demagnetizing coils 61 generate high-frequency magnetic fields for canceling magnetic fluxes of high-frequency magnetic fields generated by the second sections 60*b* of the excitation coil 60.

When the sheet 70 having the small size continuously passes between the heat belt 43 and the press roller 44, the controller 96 drives the excitation coil 60 and the demagnetizing coils 61. According to the driving of the demagnetizing coils 61, the magnetic fluxes of the high-frequency magnetic fields generated by the second sections 60*b* of the excitation coil 60 are cancelled. Therefore, it is possible to prevent an unnecessary temperature rise on both the sides of the heat belt 43.

Other components and actions are the same as those in the first embodiment. Therefore, explanation of the components and actions is omitted.

Characteristics of the seventh embodiment are explained below.

A fixing device includes:

a rotating member configured to rotate;

a pressing member configured to rotate together with the rotating member while being set in contact with the rotating member, hold a fixing object between the pressing member and the rotating member, and apply pressure to the fixing object;

plural cores arranged spaced apart from each other along a direction orthogonal to a rotating direction of the rotating member;

an excitation coil mounted on the plural cores and configured to generate a high-frequency magnetic field for induction-heating the rotating member, width of a first section of the excitation coil opposed to a first area where a fixing object having first width in the rotating member passes being larger than width of one or plural second sections opposed to second areas that are areas excluding the first area in an area where a fixing object having second width larger than the first width in the rotating member passes; and one or plural demagnetizing coils superimposed on the second sections of the excitation coil, the demagnetizing coils generating high-frequency magnetic fields for canceling magnetic fluxes of high-frequency magnetic fields generated by the second sections of the excitation coil.

[8] Eighth Embodiment

An eighth embodiment is equivalent to a modification of the seventh embodiment.

Since both the sides opposed to each other of the second sections 60*b* of the excitation coil 60 are narrowed to the inner side, it is likely that the second sections 60*b* cancel magnetic fluxes of high-frequency magnetic fields generated by the second sections 60*b*. This canceling action is stronger as a space between both the sides opposed to each other is narrower.

Figure 25:
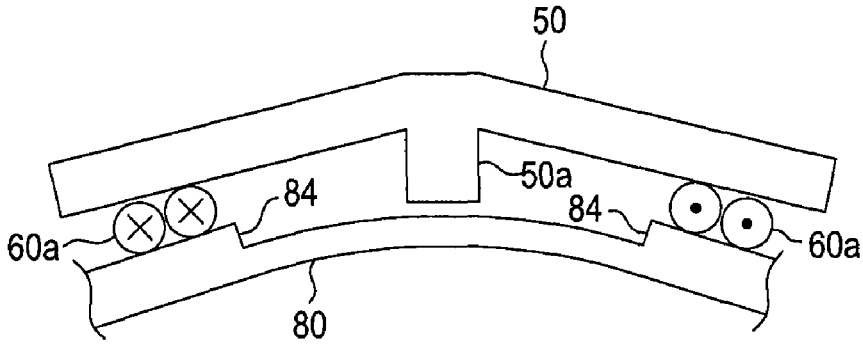
FIG. 25 is a sectional view of the configuration of an excitation coil and a holder in an eighth embodiment.

When the magnetic flux canceling action in the second sections 60*b* is strong and heat generation at both the ends of the heat belt 43 is weakened, as shown in FIG. 25, both the sides opposed to each other of the first section 60*a* of the excitation coil 60 are lifted by elevated sections 84, which are formed on the upper surface of the holder 80, and separated from the heat belt 43. FIG. 25 is equivalent to a section along line A-A in FIG. 22.

With this configuration, magnetic coupling between the first section 60*a* of the excitation coil 60 and the heat belt 43 is slightly weakened to secure good balance of magnetic coupling between the entire excitation coil 60 and the heat belt 43.

[9] Ninth Embodiment

A ninth embodiment is also equivalent to a modification of the seventh embodiment.

Figure 26:
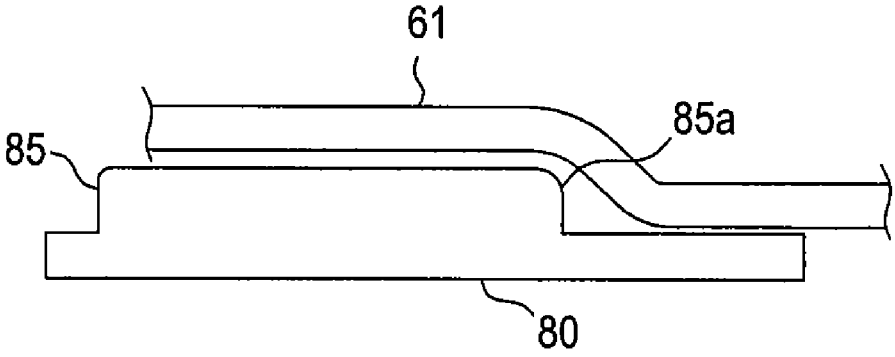
FIG. 26 is a sectional view of the configuration of a demagnetizing coil and a holder in a ninth embodiment.

When a demagnetizing action of the demagnetizing coils 61 is strong, as shown in FIG. 26, the demagnetizing coils 61 are lifted by elevated sections 85, which are formed on the upper surface of the holder 80, and separated from the heat belt 43.

It is possible to adjust the demagnetizing action of the demagnetizing coils 61 by increasing and decreasing the thickness of the elevated sections 85.

Upper edges 85*a* of the elevated sections 85 are formed in a curved surface shape. With the presence of the curved surface shape, when the demagnetizing coils 61 are simply placed on the holder 80, the demagnetizing coils 61 deform to match the elevated sections 85 of the holder 80. Therefore, work for shaping the demagnetizing coils 61 in advance is unnecessary.

[10] Tenth Embodiment

A tenth embodiment is also equivalent to a modification of the seventh embodiment.

Figure 27:
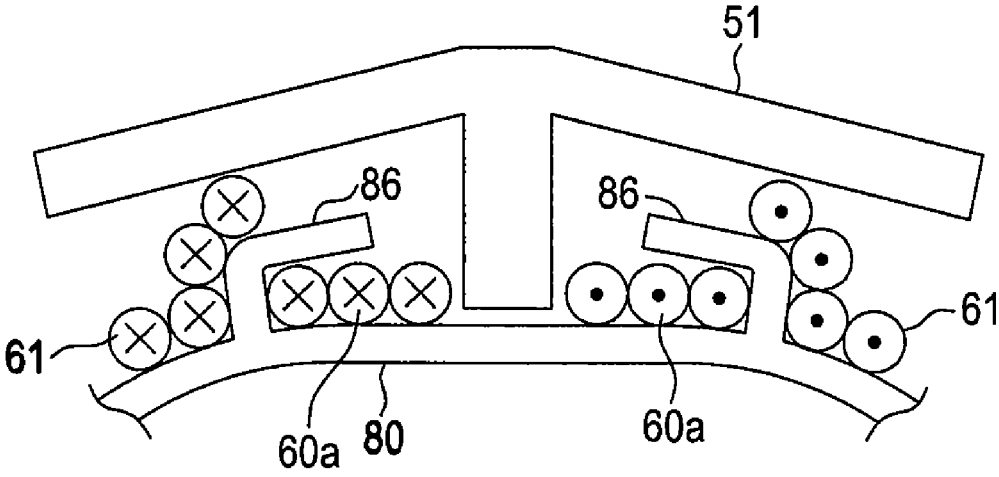
FIG. 27 is a sectional view of main parts of an excitation coil, demagnetizing coils, and a holder in a tenth embodiment.

As shown in FIG. 27, plural insulating ribs 86 on the upper surface of the holder 80 are formed in a curved surface shape that enter between the second sections 60*b* of the excitation coil 60 and the demagnetizing coils 61 and cover the second sections 60*b*. By adopting the insulating ribs 86, it is possible to surely insulate the second sections 60*b* and the demagnetizing coils 61.

FIG. 27 is equivalent to a section along line B-B in FIG. 22.

In the eighth to tenth embodiments, an operation mode for synchronizing a phase of high-frequency current fed to the demagnetizing coils 61 and a phase of high-frequency current fed to the excitation coil 60 may be prepared. In a situation in which the temperature on both the sides of the heat belt 43 falls because of some cause, it is possible to compensate for a temperature fall on both the sides of the heat belt 43 by setting this operation mode. This makes it possible to maintain the temperatures in the center and on both the sides of the heat belt 43 uniform.

[11] Eleventh Embodiment

An eleventh embodiment is also equivalent to a modification of the seventh embodiment.

Figure 28:
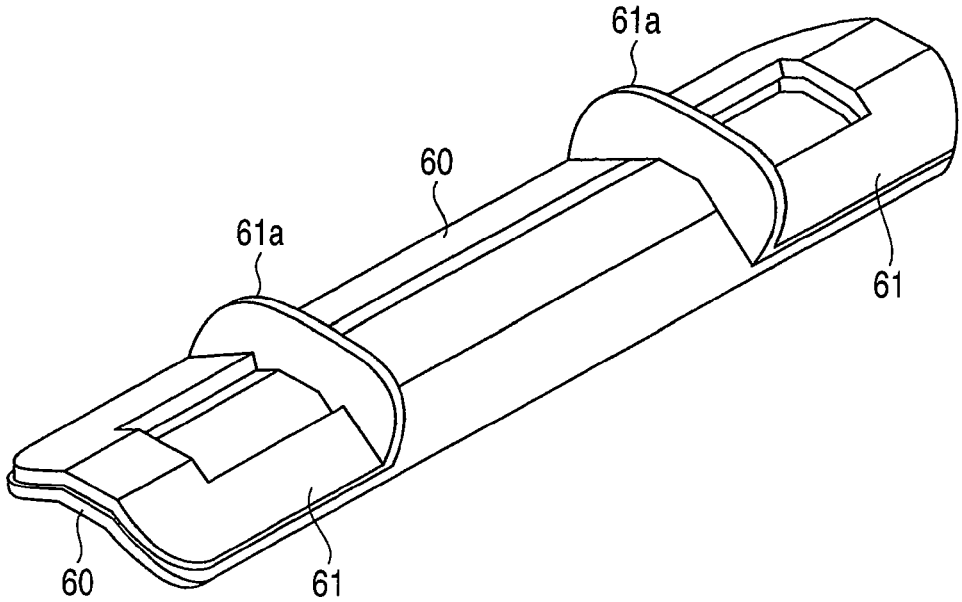
FIG. 28 is a perspective view of shapes of an excitation coil and demagnetizing coils in an eleventh embodiment.

As shown in FIG. 28, ends on sides facing the center of the heat belt 43 of the both ends of the demagnetizing coils 61 are bent sections 61*a* bent and erected in a direction away from the heat belt 43.

Figure 29:
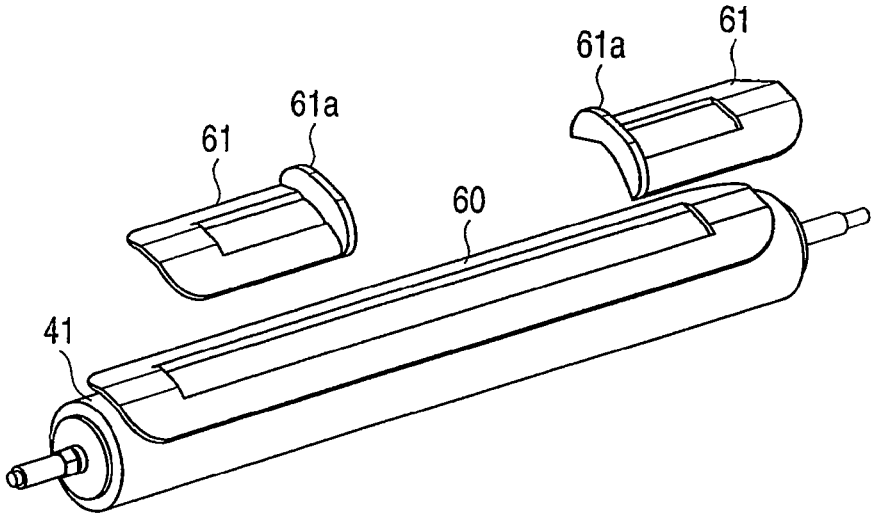
FIG. 29 is a disassembled perspective view for explaining a mutual relation between the excitation coil and the demagnetizing coils in the eleventh embodiment.
Figure 30:
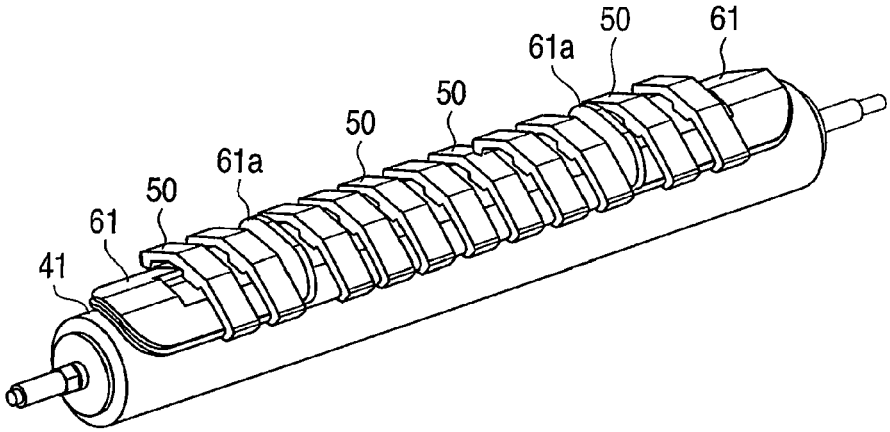
FIG. 30 is a perspective view of the configuration of the excitation coil, the demagnetizing coils, main cores, and sub-cores in the eleventh embodiment.
Figure 31:
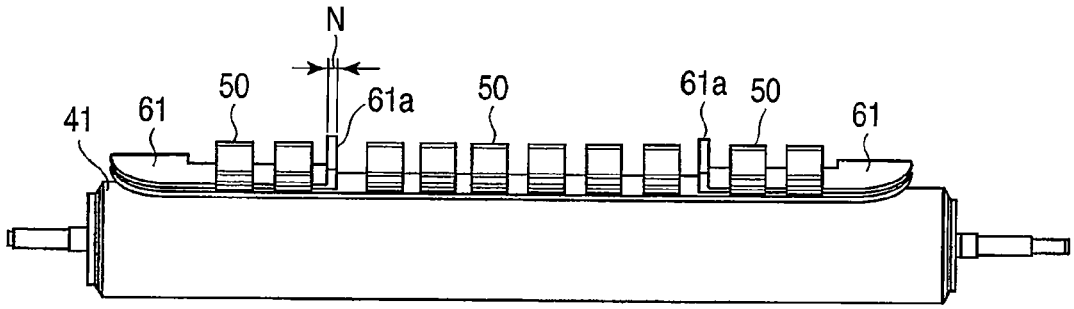
FIG. 31 is a side view of the configuration shown in FIG. 30 viewed from a side.

A mutual relation between the excitation coil 60 and the demagnetizing coils 61 is shown in FIG. 29 in a disassembled form. The configuration of the excitation coil 60, the demagnetizing coils 61, the plural main cores 50, and the plural sub-cores 51 is shown in FIG. 30. The configuration shown in FIG. 30 viewed from a side is shown in FIG. 31. The thicknesses of the plural main cores 50 and the plural sub-cores 51 are the same each other.

Figure 32:
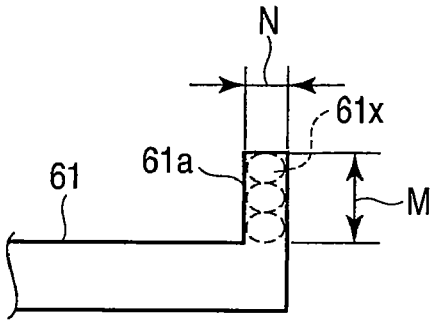
FIG. 32 is a sectional view of a bent section shown in FIG. 31 and a dimension thereof.
Figure 33:
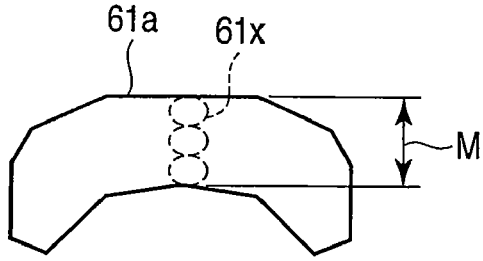
FIG. 33 is a side view of the bent section shown in FIG. 32 viewed from a side.

The bent section 61*a* shown in FIG. 31 and a dimension thereof are shown in FIG. 32. The bent section 61*a* shown in FIG. 32 viewed from a side is shown in FIG. 33.

The bent section 61*a* is formed by bending a Litz wire 61*x* that is a component of the demagnetizing coil 61. In bending the Litz wire 61*x*, the Litz wire 61*x* in a wound state is compressed in a laminating direction thereof and formed in an elliptical shape.

Consequently, a height dimension M in the laminating direction of the Litz wire 61*x* is suppressed as much as possible. A width dimension N of the bent section 61*a* in the lateral width direction of the heat belt 43 is set larger than an original wire diameter of the Litz wire 61*x*.

The bent sections 61*a* locally and concentratedly transmit magnetic fluxes of high-frequency magnetic fields generated by the demagnetizing coils 61 to the heat belt 43. The height dimension M and the width dimension N are set to increase a degree of the concentration as much as possible.

By adopting the demagnetizing coils 61, it is possible to clearly distinguish a boundary between an area where the canceling action is applied to magnetic fluxes of a high-frequency magnetic field generated by the excitation coil 60 and an area where the canceling action is not applied.

Figure 34:
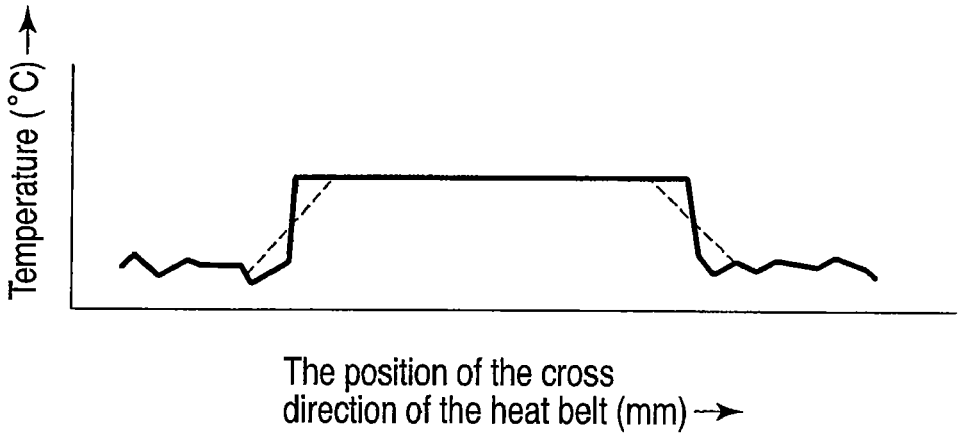
FIG. 34 is a diagram of temperature distribution in a width direction of a heat belt in the eleventh embodiment.

Temperature distribution in the lateral width direction of the heat belt 43 is shown in FIG. 34. Temperature is fixed in the center of the heat belt 43 and steeply falls in sections away from the center. A broken line in the figure indicates, as a reference, temperature distribution obtained when the bent sections 61*a* are not formed. The inclination of a temperature fall from the center is gentle.

Characteristics of the eleventh embodiment are explained below.

A fixing device includes:

a rotating member configured to rotate;

a pressing member configured to rotate together with the rotating member while being set in contact with the rotating member, hold a fixing object between the pressing member and the rotating member, and apply pressure to the fixing object;

plural cores arranged spaced apart from each other along a direction orthogonal to a rotating direction of the rotating member;

an excitation coil mounted on the plural cores and configured to generate a high-frequency magnetic field for induction-heating the rotating member; and one or plural demagnetizing coils mounted on the plural cores, the demagnetizing coils being opposed to second areas in areas including a first area where a fixing object having first width in the rotating member passes and the second areas that are areas excluding the first area in an area where a fixing object having second width larger than the first width in the rotating member passes and generating high-frequency magnetic fields for canceling magnetic fluxes of the high-frequency magnetic fields generated by the excitation coil, and ends on sides facing the first area of which being bent in a direction away from the rotating member.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A fixing device comprising:

a rotating member configured to rotate;

a pressing member configured to rotate together with the rotating member while being set in contact with the rotating member, hold a fixing object between the pressing member and the rotating member, and apply pressure to the fixing object;

plural first cores arranged spaced apart from each other along a shaft direction of the rotating member, opposed to a first area of the rotating member and having a fixed thickness in the shaft direction of the rotating member;

plural second cores arranged spaced apart from each other without any member in between along the shaft direction of the rotating member, opposed to second areas of the rotating member and having a thickness in the shaft direction of the rotating member smaller than the thickness of the plural first cores; and an excitation coil mounted on the plural first and second cores and configured to generate a high-frequency magnetic field for induction-heating the rotating member.

2. The device of claim 1, wherein the plural first cores are opposed to the first area of the rotating member where a fixing object having a first width passes and has a fixed thickness in the shaft direction thereat, and the plural second cores opposed to the second areas of the rotating member are areas excluding the first area in an area where a fixing object having a second width larger than the first width passes.

3. The device of claim 1, wherein a mutual interval of the plural second cores is smaller than a mutual interval of the plural first cores.

4. The device of claim 1, wherein the thickness of the plural second cores is a half of the thickness of the plural first cores.

5. The device of claim 4, wherein each of the first cores is a composite of plural cores each having width same as that of each of the second cores.

6. The device of claim 1, wherein the plural second cores have thicknesses gradually decreasing farther away from the first area of the rotating member.

7. The device of claim 1, wherein the plural first cores are opposed to the first area of the rotating member, at least one section of the first cores being formed in a projected shape closer to the rotating member than other sections, and the plural second cores are opposed to the second areas of the rotating member, at least one section of the second cores being formed in a projected shape closer to the rotating member than the other sections and a width of the projected shape section of the second cores being smaller than a width of the projected shape section of the first cores.

8. The device of claim 1, further comprising:

a temperature sensor configured to detect temperature of the first area of the rotating member; and a controller configured to control output of the excitation coil for maintaining detected temperature of the temperature sensor at a set value decided in advance.

9. The device of claim 1, further comprising:

a first temperature sensor configured to detect temperature T1 of the first area of the rotating member;

a second temperature sensor configured to detect temperature T2 of the second areas of the rotating member; and a controller configured to control output of the excitation coil for maintaining the detected temperature T1 of the first temperature sensor at a set value decided in advance and reduce the output of the excitation coil when the detected temperature T2 of the second temperature sensor abnormally rises.

10. A fixing device comprising:

a heat belt configured to rotate;

a press roller configured to rotate together with the heat belt while being set in contact with the heat belt, hold a sheet between the press roller and the heat belt, and apply pressure to the sheet;

plural first cores arranged spaced apart from each other along a shaft direction of the heat belt, opposed to a first area of the heat belt and having a fixed thickness in the shaft direction of the heat belt;

plural second cores arranged spaced apart from each other without any member in between along the shaft direction of the heat belt, opposed to second areas of the heat belt and having a thickness in the shaft direction of the heat belt smaller than the thickness of the plural first cores; and an excitation coil mounted on the first and second plural cores and configured to generate a high-frequency magnetic field for induction-heating the heat belt.

11. The device of claim 10, wherein the plural first cores are opposed to the first area of the heat belt where a sheet having a first width passes and has a fixed thickness in the shaft direction thereat, and the plural second cores opposed to the second areas of the heat belt are areas excluding the first area in an area where a sheet having second width larger than the first width passes.

12. The device of claim 10, wherein a mutual interval of the plural second cores is smaller than a mutual interval of the plural first cores.

13. The device of claim 10, wherein the thickness of the plural second cores is a half of the thickness of the plural first cores.

14. The device of claim 13, wherein each of the first cores is a composite of plural cores each having width same as that of each of the second cores.

15. The device of claim 10, wherein the plural second cores have thicknesses gradually decreasing farther away from the first area of the heat belt.

16. The device of claim 10, wherein the plural first cores are opposed to the first area of the heat belt, at least one section of the first cores being formed in a projected shape closer to the heat belt than other sections, and the plural second cores are opposed to the second areas of the heat belt, at least one section of the second cores being formed in a projected shape closer to the heat belt than the other sections and a width of the projected shape section of the second cores being smaller than a width of the projected shape section of the first cores.

17. The device of claim 10, further comprising:

a temperature sensor configured to detect temperature of the first area of the heat belt; and a controller configured to control output of the excitation coil for maintaining detected temperature of the temperature sensor at a set value decided in advance.

18. The device of claim 10, further comprising:

a first temperature sensor configured to detect temperature T1 of the first area of the heat belt;

a second temperature sensor configured to detect temperature T2 of the second areas of the heat belt; and a controller configured to control output of the excitation coil for maintaining the detected temperature T1 of the first temperature sensor at a set value decided in advance and reduce the output of the excitation coil when the detected temperature T2 of the second temperature sensor abnormally rises.

19. An image forming apparatus comprising a fixing device configured to fix an image formed on a sheet on the sheet with heating, wherein the fixing device includes:

a rotating member configured to rotate;

a pressing member configured to rotate together with the rotating member while being set in contact with the rotating member, hold a fixing object between the pressing member and the rotating member, and apply pressure to the fixing object;

plural first cores arranged spaced apart from each other along a shaft direction of the rotating member, opposed to a first area of the rotating member and having a fixed thickness in the shaft direction of the rotating member;

plural second cores arranged spaced apart from each other without any member in between along the shaft direction of the rotating member, opposed to second areas of the rotating member and having a thickness in the shaft direction of the rotating member smaller than the thickness of the plural first cores; and an excitation coil mounted on the first and second plural cores and configured to generate a high-frequency magnetic field for induction-heating the rotating member.

20. The apparatus of claim 19, wherein the plural first cores are opposed to the first area of the rotating member where a fixing object having first width passes and has a fixed thickness in the shaft direction thereat, and the plural second cores opposed to the second areas in the rotating member are areas excluding the first area in an area where a fixing object having second width larger than the first width passes.

* * * * *